United States Patent [19]

Williams

[11] Patent Number: 4,830,290

[45] Date of Patent: May 16, 1989

[54] ROLLER GRINDING MILL

[76] Inventor: Robert M. Williams, 16 La Hacienda, Ladue, Mo. 63124

[21] Appl. No.: 214,648

[22] Filed: Jul. 1, 1988

[51] Int. Cl.[4] ..... B02C 15/02

[52] U.S. Cl. ..... 241/59; 241/109; 241/124

[58] Field of Search ..... 241/48, 55, 58, 59, 241/57, 109, 123–133, 601; 366/101, 102, 107

[56] References Cited

U.S. PATENT DOCUMENTS 1,769,352 7/1930 Libbey ..... 241/48
1,781,572 11/1930 Drummond .
1,834,094 12/1931 Fraser .
1,936,593 11/1933 Fraser ..... 241/48
4,522,343 6/1985 Williams .

*Primary Examiner*—Mark Rosenbaum
*Attorney, Agent, or Firm*—Gravely, Lieder & Woodruff

[57] ABSTRACT

An improved roller grinding mill in which a material grinding chamber is supplied with air in a tangential flow path through a multiple array of tangentially directed passages, material grinding rollers operate in a direction counter to the tangential air flow into the grinding chamber, and plows rotating in the same direction with the grinding rollers and formed with sloped surfaces for imparting an upward lift on the material to be ground for improving the fluidization of the material and maintaining a substantially constant particle size for delivery through the mill outlet.

6 Claims, 2 Drawing Sheets

FIG. 2.
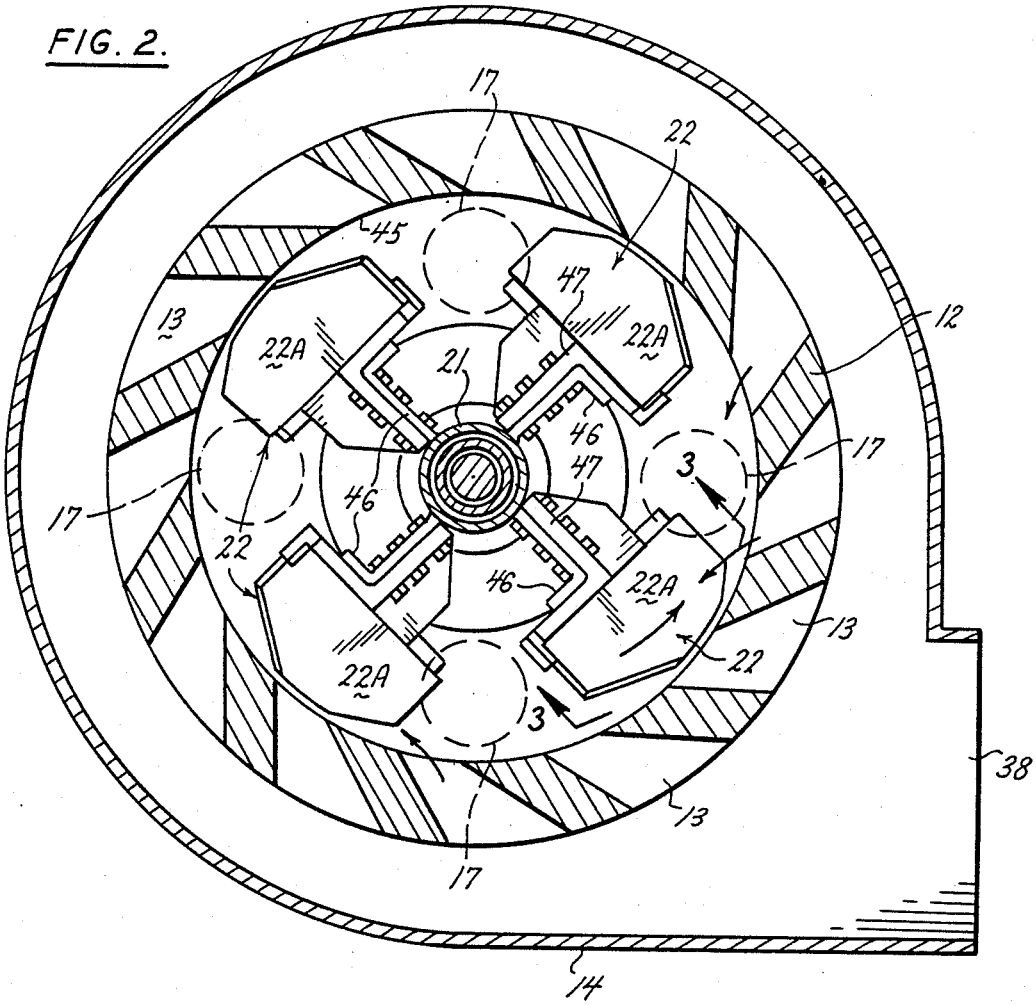
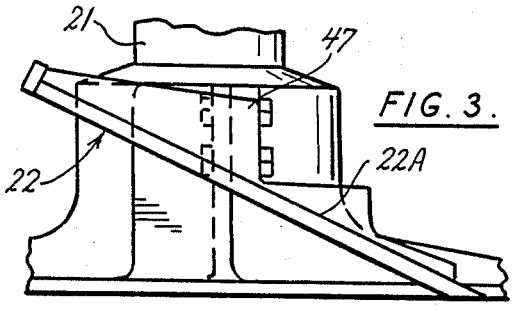
FIG. 3.
FIG. 4.
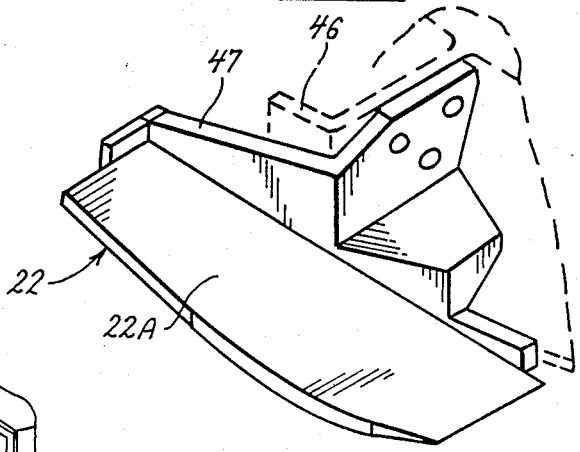
FIG. 5.
(PRIOR ART)
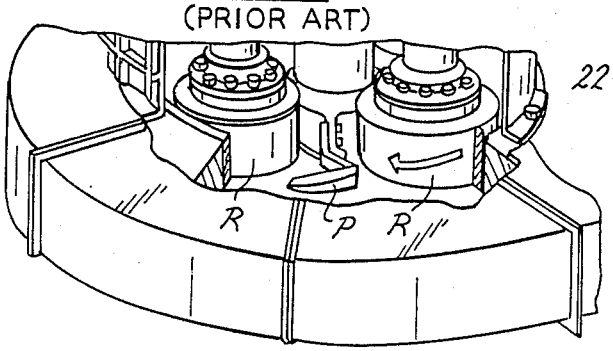

ROLLER GRINDING MILL

BACKGROUND OF THE INVENTION

1. Field of the Invention

This invention is concerned with a unique operation of a roller grinding mill to process granular fuel material to a predetermined particle size with a minimum of air and without a classifier unit.

2. Description of the Prior Art

As far as is known, roller grinding mills, almost from the very first, were constructed so that the grinding rollers and the cooperating plows were driven in a circular path in a circular grinding chamber so that both the rollers and plows moved in the direction of the air admitted to the grinding chamber or at least perpendicular (across) to the flow of the air entering the grinding chamber. It was never recognized that this long-standing arrangement of the plows and air inlet provisions caused the plows to centrifuge the material into the air and away from between the grinding rolls and the bull ring means to the detriment of particle size control. The answer to that problem almost universally has been that roller mills had to be provided with some sort of classifier device outside of the mill to obtain the desired sort of material particle size, and so the desired control over the particle size of the ground material that was allowed to pass into the outlet duct system was obtained. That arrangement was satisfactory as long as the output delivery to a burner was combined with its own secondary combustion supporting air.

When the handling of fuel material went to the stage that direct supply to a burner was demanded, a wholly different system of treating the fuel material was needed. When fuel material was processed in the mill and delivered directly to the burner, problems arose in the need to supply an excess of air into the mill to control the particle size and that was found to be getting too much air at the burner, which was an inefficient way to fire a burner, and the products of combustion became troublesome pollutants in the atmosphere.

Typical examples of older conventional types of roller grinding and pulverizing mills are seen in U.S. Pat. Nos. 1,769,352 of July 1, 1930 and 1,936,593 of Nov. 28, 1930. In these mills the rollers and plows travel in a direction (usually clockwise) with the flow of the air delivered into the grinding chamber so that the material lifted up to be crushed occurs in front of the rollers. However, that lifting of the material is offset and greatly neutralized by the pitch of the plows catching the air flow on the back side with the result that the air is diverted t the outside. Since the air velocity is higher than the plow velocity, the slower plows create sudden formation of disturbances in the airflow similar to the cavitation effect in fluid flow which generates turbulence that causes movement of the material to the outside surface of the grinding chamber under centrifugal forces acting on the material. It is believed this results in pulverizing the material to a fine particle size as it remains longer in the grinding chamber.

The conventional roller mills are formed to require more air in order to lift the particles, and the particle sizes are not uniform so an extra piece of equipment in the form of a classifier is needed in the mill output to return oversize particles to the mill for further reduction.

BRIEF DESCRIPTION OF THE INVENTION

In one preferred form of the invention, the improvement resides in the combination in a granular fuel material processing mill having grinding rollers travelling in a circular grinding chamber, an air receiving bustle surrounding said grinding chamber and formed with a series of air flow directing passages angled generally tangentially to the interior of the circular grinding chamber, and means for driving the grinding rollers in a direction counter to the tangentially directed air flow entering the grinding chamber, of plow means moving with the grinding rollers and having face surfaces presented to the granular fuel material and simultaneously directing the air to upwardly fluidize the material. Thus there is now an arrangement for supplying air thereto through the tangential air passages, and employing plow means in a new way for fluidizing the material in the grinding chamber. This allows modulating the speed of the rollers and plows to control grinding capacity so the angle of the plows cooperate with fluidization to offset the tangential centrifuging effect of the grinding components. This enables a control to increase or decrease fluidization and still maintain a substantially constant outlet particle size.

Another unique object of the invention, on reversing the direction of rotation of the grinding rolls and the plows, is to cause the plow face which is at an angle to the incoming air to force the air to flow upwardly and lift the material into the grinding rolls in a nonturbulent change of direction, and to shape the back side of the plows so there is little or no interference with the direction of flow of the incoming air when the next plow presents its face to the air flow. Thus, the speed of the plows has an increased tendency to fluidize the material rather than centrifuge such material, so the net result is that the mill is able to hold the material to a substantially constant particle size.

Another unique object of this invention resides in being able to utilize the air and plow means to fluidize the material and allow the air to carry the desired size of particles to the outlet. As the speed of the plows increase, they have an increased tendency to fluidize the material rather than centrifuge the material, so the net result is to hold the particle size to a substantially constant size.

In a more specific embodiment, with the air entering the grinding chamber at a velocity of the order of 3000 feet per minute and the plow means rotating at from 50 to 100 RPM (theoretically at about 680 feet per minute), the pitch angle of the order of 20° to 40° of the face of the plow means encounters the relatively higher velocity streams of air which causes the air to rapidly fluidize the material particles so that the particle size is more easily controlled, does not become finer due to rotational speed, and supplies a size at the burner that induces the combustion rate to reduce the creation of nitrous oxide.

BRIEF DESCRIPTION OF THE DRAWINGS

The present invention is embodied in the following drawings wherein:

FIG. 2 is a sectional view taken along line 2—2 in FIG. 1 of the material grinding chamber at the level of the grinding rollers, plows;

FIG. 3 is an end view of a typical plow seen along line 3—3 in FIG. 2;

FIG. 4 is a perspective view of a typical plow; and

FIG. 5 is a fragmentary perspective view of a typical prior art roller grinding mill.

DETAILED DESCRIPTION OF THE EMBODIMENT

Figure 1:
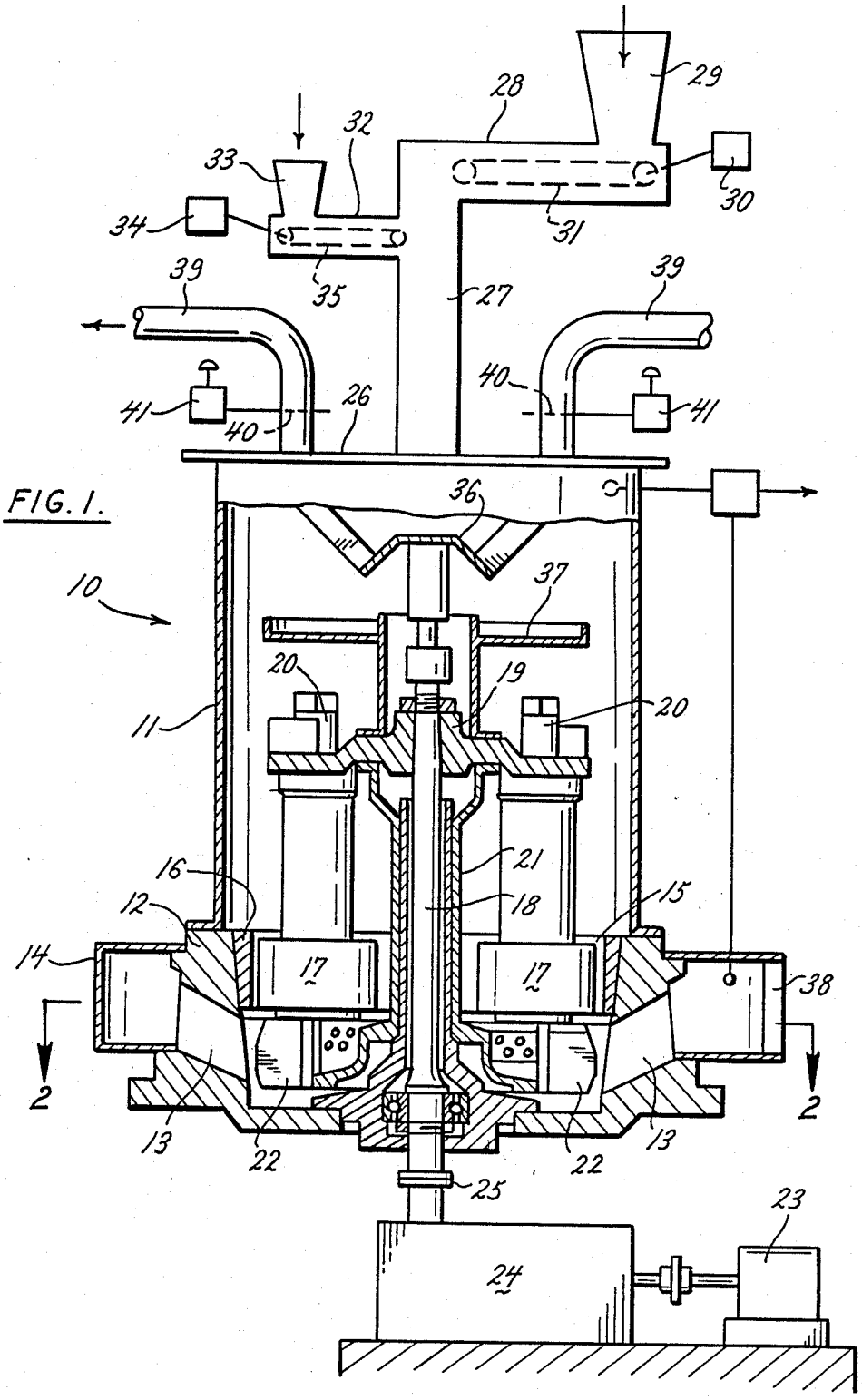
FIG. 1 is a vertical elevation, partly in sections, of a material grinding roller mill illustrating the features of the invention.

With reference to FIG. 1 the roller grinding mill, as shown generally at 10, comprises a housing 11 having a base casting 12 in which are formed tangentially directed air passages 13. The passages 13 are in communication with a surrounding bustle 14 which introduces air at a selected velocity into the series of passages 13 which encircle the grinding chamber 15 defined by a stationary bull ring 16 against which a series of grinding rollers 17 operate to reduce fuel material, or the like, which is introduced into the housing 11. There is a central drive shaft 18 operating a head member 19 which is connected by suitable journals 20 to drive the grinding rollers 17. The head member 19 is operatively connected to a concentric torque tube 21 and the tube 21 is connected to a series of plows 22 operating in the base casting 12 below the position of the grinding rollers 17. A drive motor 23 is suitably coupled to a transmission or gear box 24 which delivers power through the coupling 25 to the vertically extending shaft 18.

The top 26 of the housing 11 is formed with a material inlet tube 27 which, in turn, is connected to the primary material feed assembly 28 for delivering material deposited in the hopper 29 to the feed tube 27. A drive motor 30 is connected to a belted conveyor 31 in the feed assembly 28 for delivering the material from the hopper 29 to the feed tube 27. There is a second feed assembly 32 for delivering limestone from hopper 33 into the feed tube 27 to commingle the limestone with the fuel material from the feed assembly 28. Motor means 34 drives a conveyor 35 to deliver the limestone material into the feed tube.

The feed tube delivers the feel and limestone material into the upper space of the housing 11 and delivers it onto a stationary spreader 36 which directs the flow of material onto a distributor plate 37 for distributions centrifugally outwardly in the housing 11. The distributor plate 37 is directly connected to the head 19 and thereby rotates concurrently with the grinding rollers 17.

The air supply bustle 14 has an inlet connection 38 for the delivery of air from an exterior source to flow through the series of air passages 13 where the air will move the material into the grinding rollers 17. Any particles of the material that become responsive to the upward flow of the air in the housing 11 will be swept upwardly past the distributor plate 37 and there pick up and strip other incoming particles of an air responsive size to deliver the particles of material through one or more outlet conduits 39. Each of the conduits 39 is provided with a gate 40 which is opened or closed by motor means 41.

A suitable control over the operation of the mill 10 is disclosed in my pending application Ser. No. 126,032, filed Nov. 27, 1987. Such a control is embodied in this application by reference to that prior application at FIG. 5 therein. In this copending application, the pressure differential across the mill 10 is measured by a suitable manometer device 49 connected to a sensor 50 in the head space of the housing 11 and to a cooperating sensor 51 in the bustle or wind box 14. As disclosed in that prior application but omitted here, a computer is operatively connected to the manometer device 49 and to the respective drive motors 23, 30, 34 and 41. The computer controls the operation of the various motors for providing the ground fuel material to a burner (not shown) in accordance with burner demand. However in this copending application, the unique difference is associated with the fluidizing of the material in the mill with less air volume and that leaves the need for supplementary to be supplied directly at the burner.

Turning now to FIG. 2 it can be seen that the bustle 14 surrounds the base casting 12 in which are formed a series of air flow passages 13 which are directed tangentially to the interior circular wall 45, the wall 45 defining the interior circumference of the grinding chamber 15 below the level of the bull ring 16. In the view of FIG. 2 the tangential direction of the air flow passages is in a clockwise direction so that the air entering at the inlet 38 tends to drive the material reaching the grinding chamber in a generally clockwise direction. The view of FIG. 2 is taken below the grinding rollers 17 so that these rollers 17 are shown in dotted outline so as to illustrate the relative position of the grinding rollers 17 to the plows 22. Each of the plows 22 is bolted or otherwise suitably connected to the arm 46 which is a part of the torque tube 21. Each plow has its own bracket 47 which is integrally cast or otherwise connected to the plow 22 so that the face surface 22A of each of the plows is pitched to an angular position. The unique characteristic of the present roller grinding mill is embodied in the way the drive motor 23 operates to rotate the grinding rollers in a counterclockwise direction and to concurrently, through the torque tube 21, drive the plows 22 also in a counterclockwise direction. Since the plows move in a counterclockwise direction relative to the clockwise and tangentially directed air flow through the passage 13, the plow faces 22A impact on the incoming air flow and fluidize the material that is being processed in the grinding chamber 15 so as to create upward circulation of the material in the grinding chamber for maintaining a body of the material between the grinding rolls 17 and the bull ring 16. Simultaneously, the fluidizing of the material causes the particles that are responsive to the fluidizing air to be carried upwardly past the distribution plate 37 and to the outlets 39. Particles that are not air responsive at the level of the distribution plate 37 fall into the grinding chamber in counter current movement to the air responsive particles being moved upwardly.

Looking at FIGS. 3 and 4, it can be seen that each of the plows 22 has an angularly pitched face 22A supported by its bracket 47 attached to the supporting arm 46 on the torque tube 21. The body of the plows 22 has a sufficient mass to support it in a relatively rigid position since the plows are intended to rotate at from 50 to 100 RPM against the weight of the material in the grinding chamber and against the flow of the air which is delivering at an average velocity of about 3000 FPM.

It has been determined that, without exception, prior roll grinding mills have operated with the grinding rollers and the plows moving in a clockwise direction with the direction of the incoming air flow. An example of this prior art arrangement is illustrated in FIG. 5 where grinding rollers R and an intervening plow P are shown t be moving in a clockwise direction in relation to the surrounding air bustle B. A typical example of the prior art can be seen in the 1930 patent of Libbey U.S.

Pat. No. 1,769,352, and other similarly arranged roller grinders or pulverizers of tee same early vintage.

In a direct firing system, the fuel rate must be subject to control (automatic is preferred) by the boiler load demand. At the same time, the air flow rate needs to be controlled to provide the correct air-fuel ratio while still maintaining the drying and fluidization processes.

Grinding is promoted by internal recirculation of the oversize material through the grinding zone without producing super fine particles. The recirculation within the roller mill is important as it promotes rapid drying by mixing the incoming material with dry material already in the mill, it keeps the grinding rolls loaded at all times, and the circulation removes pulverized material from the grinding zone.

Once the material is ground and classified, it must be evacuated by the velocity of the air through the outlet being high enough to prevent material settling in the ducts. The outlet being connected to a burner, the air-fuel material ratio must be uniform and the velocity suitable for combustion with sufficient secondary air.

Control of circulating fluidize bed exhaust pollutants is important. In a coal fired furnace, the smaller or finer the particle size is the higher the surface-to-oxygen ratio which results in a higher reaction rate which causes the reaction temperature to increase and that allows for the formation of nitrous oxide molecules. By increasing the coal particle size and minimizing the fines, the combustion reaction will be slowed down, decreasing temperature and preventing the formation of nitrous oxide molecules.

However, the problem with this postulation is that larger particles have a high mass to surface area ratio and require better fluidization in the pulverizer to allow the burning of larger particle sizes.

The foregoing specification has disclosed a preferred embodiment of the invention, but it is understood that the scope of the invention is not to be unnecessarily limited as those skilled in this art understand that changes may be made which are equivalent substitutions.

What is claimed is:

1. A grinding mill for product size control, said grinding mill comprising:

(a) a housing having a product inlet and a ground product outlet and means defining a grinding chamber having a circular grinding surface;

(b) material grinding rollers operably mounted in said housing for movement in a circular path for grinding product against said grinding surface;

(c) air inlet openings adjacent said grinding surface and extending along said circular path of said grinding rollers, said inlet openings directing the flow of air at an angle to the circumference of the circular path;

(d) means for driving said grinding rollers in a direction opposite to the angular direction of the air flow in said inlet openings;

(e) plow means connected to and rotating in the same direction with said grinding rollers, said plow means following a path in said grinding chamber to intercept the flow of air into the grinding chamber through said inlet openings, said plow means having surfaces presented at predetermined angles to the flow of incoming air to divert the air flow in a direction to elevate the product through the path of the grinding rollers at a rate proportional to the rate of rotation of said grinding rollers for controlling the size of the product air delivered to said outlet.

2. The grinding mill set forth in claim 1 wherein said grinding rollers and plow means rotate at varying speeds to produce a product output substantially matching the rate of combustion of such product.

3. The grinding mill set forth in claim 1 wherein said means to supply air develops an air velocity of substantially 3000 feet per minute, said grinding rollers and plows are rotated by said driving means at a speed selected from about fifty RPM to about one hundred RPM; and said plow surfaces are pitched at an angle to boost the material vertically.

4. The combination in a coal processing roller mill having a circular grinding chamber with a series of generally horizontally directed air flow inlet passages opening into the chamber at an angle generally tangentially to the circular grinding chamber, processing rollers, for driving the processing rollers in a direction opposite to the predetermined direction of the air flow into the grinding chamber, and plow means moving in the same direction with said rollers, said plow means presenting a surface to impact on the air flow for directing the air flow into the processing rollers and fluidizing the coal.

5. The combination set forth in claim 4 wherein said plow means pitches the coal vertically in greater volume than the coal volume movement centrifugally in the grinding chamber.

6. The combination set forth in claim 4 wherein modulating the drive means for operating said processing rollers to control the output, said plow means cooperates with the air fluidization to offset the tangential centrifuging effect of the processing rollers to maintain a substantially constant particle size.

* * * * *

UNITED STATES PATENT AND TRADEMARK OFFICE

CERTIFICATE OF CORRECTION

PATENT NO. : 4,830,290

DATED : May 16, 1989

INVENTOR(S) : Robert M. Williams

It is certified that error appears in the above-identified patent and that said Letters Patent is hereby corrected as shown below:

Column 6, line 35, "means" should be inserted before "for driving".

Signed and Sealed this

Sixteenth Day of January, 1990

*Attest:*

JEFFREY M. SAMUELS

*Attesting Officer*

*Acting Commissioner of Patents and Trademarks*